US008195080B2

(12) United States Patent
Dergham et al.

(10) Patent No.: US 8,195,080 B2
(45) Date of Patent: Jun. 5, 2012

(54) WASTE CYCLONE DISPENSE SYSTEM WITH CONTROLLED ROTATING CYLINDER GATE

(75) Inventors: Ali R. Dergham, Fairport, NY (US); Timothy M. Davis, Macedon, NY (US); Jorge M. Rodriguez, Webster, NY (US); Randall E. Kaufman, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 355 days.

(21) Appl. No.: 12/572,308

(22) Filed: Oct. 2, 2009

(65) Prior Publication Data

US 2011/0081178 A1 Apr. 7, 2011

(51) Int. Cl.
*G03G 21/00* (2006.01)

(52) U.S. Cl. ..... 399/360; 399/35

(58) Field of Classification Search ..... 399/360, 399/35

See application file for complete search history.

(56) References Cited

U.S. PATENT DOCUMENTS

| | | | | |
|---|---|---|---|---|
| 4,996,538 | A * | 2/1991 | Brecy et al. | 346/74.3 |
| 5,260,755 | A * | 11/1993 | Imaizumi | 399/35 |
| 7,509,086 | B2 * | 3/2009 | Shirai | 399/358 |
| 2009/0022532 | A1 * | 1/2009 | Fukunaga et al. | 399/360 |

FOREIGN PATENT DOCUMENTS

JP 60179775 A * 9/1985

* cited by examiner

*Primary Examiner* — Constantine Hannaher

(74) *Attorney, Agent, or Firm* — Ronald E. Prass, Jr.; Prass LLP

(57) ABSTRACT

This is a waste cyclone toner dispense system with a controlled gate and a collection bag below the gate. The controlled gate prevents pressure from entering the bag thereby permitting the use of relatively inexpensive bags for collection of toner debris. The gate has rotating blades tightly pushed against a sealing wall, such as rubber or the like. The wall must prevent pressure from reaching the bag and remaining only above the bag. The rotating blades convey waste toner from an upper collection to the collection bag.

14 Claims, 5 Drawing Sheets

WASTE CYCLONE DISPENSE SYSTEM WITH CONTROLLED ROTATING CYLINDER GATE

This invention relates to an electrostatic marking system and more significantly to a toner waste dispensing assembly.

CROSS REFERENCE TO RELATED APPLICATIONS

Illustrated and disclosed in a co-pending application Ser. No. 12/572,334 owned by the present assignee is an application relating to a controlled, collapsible gate in a toner waste dispenser assembly. The application Ser. No. 12/572,334 is filed in the U.S. Patent and Trademark Office on the same date as the present application Ser. No. 12/572,308, the disclosure of Ser. No. 12/572,334 is totally incorporated herein by reference.

BACKGROUND

A typical electrophotographic or electrostatographic reproduction machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrostatographic reproduction machine to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer or station for developing the electrostatic latent image with toner particles. Each developer station deposits different color toner particles on the respective electrostatic latent image. The images are developed, at least partially in superimposed registration with one another, to form a multi-color toner powder image.

Excess toner is eliminated from the machine and waste toner is collected in a waste toner container and then removed when filled and disposed of, since in color systems waste toner cannot be reused.

Some xerographic or electrophotographic machines exhaust waste dry ink (toner) at a rate of approximately 320 grams/hour (actual rate varies with job area coverage, stock size, toner aging purge parameters and manifold emissions). At this rate a current used Waste Dry Ink Container has to be replaced approximately every 25 hours. Furthermore, the waste container has stringent strength requirements: sustain 6 inches wg vacuum pressure and hold 16 lb. weight.

Because of the high waste rate and stringent strength requirements, a very expensive plastic container is currently used in several machines. The high replacement rate leads to about 35 tons of plastic waste per year per machine.

Designing a simpler waste cyclone dispense system would make the electrophotographic marking apparatus a greener machine by reducing plastic waste in the landfill. It would also reduce the piece part cost of a high replacement item.

SUMMARY

This invention proposes an alternative to eliminate the vacuum pressure requirement on the current waste dry ink container. Using a hard, thick plastic container will no longer be necessary. By using an airtight seal between the collection vessel and the funnel, the necessity of a rigid-strong pressure resistant plastic collection container of the prior art is avoided. In place of this expensive plastic collection container, a substantially less expensive collection bag can be used. The cyclone separators in the system no longer apply a 6_inch wg vacuum pressure on the big waste container of this invention. This invention proposes the use of a Rotating Cylinder/Gate to assist the Waste Container and prevent suction to the Cyclone Separators. The vacuum pressure is only maintained in the collection assembly above waste the toner exit to the bag and is not maintained below as the toner enters the collection waste bag. This feature will be described in detail in the drawings of this disclosure.

This invention provides a toner collection assembly to replace the waste collection container for an existing waste dry ink container. The requirements of high fill rate and mass and internal vacuum lead in the prior art to frequent replacement of a thick plastic container. In this invention a waste assembly is provided that eliminates the requirement to sustain an internal vacuum using either an actuated rotating gate to seal the container from the vacuum source. This allows an inexpensive thin-walled container or bag to be used. This invention provides a cheaper, flimsier bag container that can be used if it is isolated from the vacuum source by a valve. Toner would be allowed to pile up above the valve, then it would drop into the container when the valve is periodically opened.

While the collection container will be described herein as a "bag", other inexpensive collection containers may be used, if suitable, such as degradable boxes or other degradable paper or plastic collectors; these are included in the term "bag" as used in this disclosure. The bags used are in one embodiment similar to bags used in vacuum cleaners. The collection system or assembly of this invention is particularly well suited for color multiple station marking systems but obviously can also be used in monochromatic marking systems.

The collection bag of the present invention can easily be retrofitted into those existing toner waste collection stations presently being used. It is important that the bags used be UL approved or have similar private or governmental approval and acceptance. In place of the highly preferred rotating gate of this invention, obviously any other suitable controlled gates or toner conveyors may be used to deposit waste toner in the bag.

BRIEF DESCRIPTION OF THE DRAWINGS

FIG. 5 is an expanded view of the rotating gate used in this invention between the toner outlet and the collection bag.

DETAILED DISCUSSION OF DRAWINGS AND PREFERRED EMBODIMENTS

Figure 1:
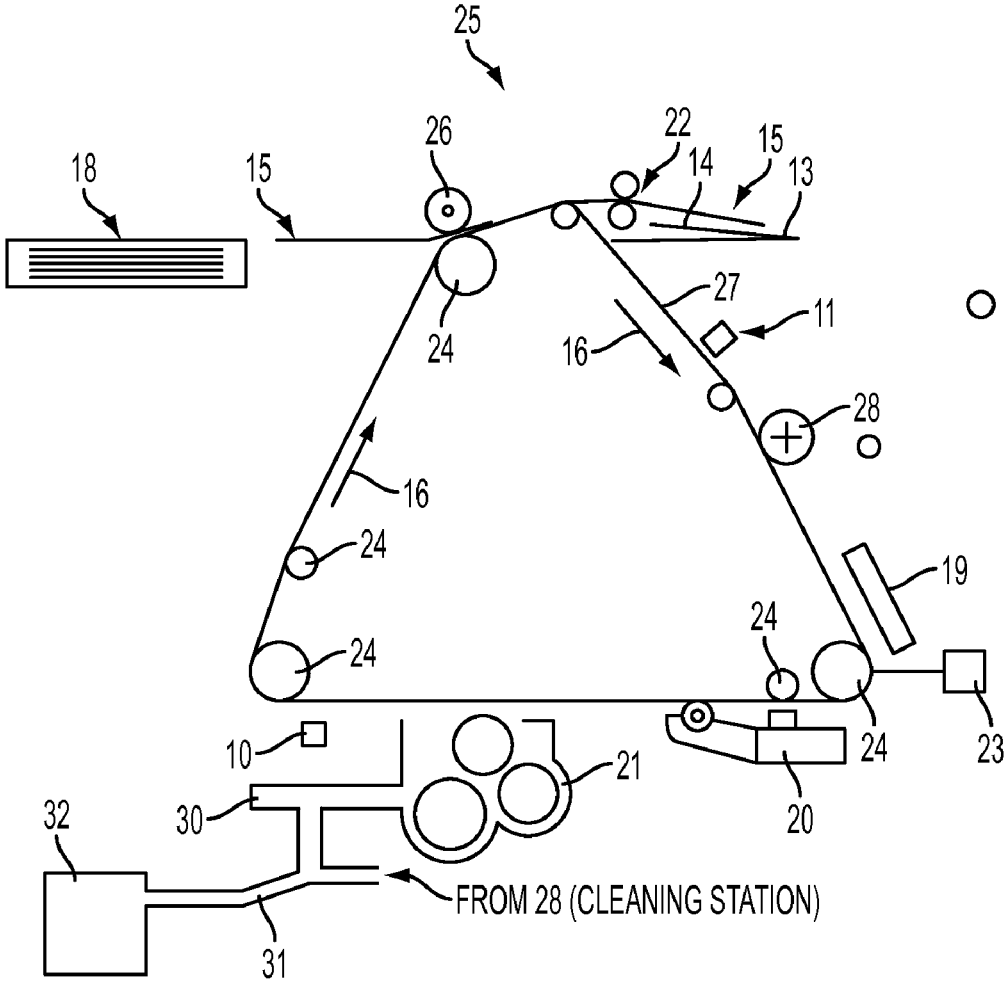
FIG. 1 is a schematic view of an electrophotographic marking system that can utilize the toner collection assembly of the present invention.

In FIG. 1 a monochromatic electrophotographic marking system is shown for simplicity and ease of understanding. It should be noted, however, that multi-station color systems using from 4-6 units of xerographic system 25 illustrated in FIG. 1 are within the scope of this invention. While both monochromatic and multi unit color system are within this invention, use of the toner waste collection assembly 32 of this invention is most beneficial in multi-unit color systems where 4-6 different colored toners are used and much more toner waste occurs. In FIG. 1 the following numbers are used to designate the following Xerographic system components.

In FIG. 1 the following are illustrated:

10. sensor
11. sensor
13. stacking assembly
14. collection station
15. paper
16. arrows of belt movement
18. paper feed
19. charging station
20. exposure station
21. developer station
22. fusing station
23. motor
24. rollers
25. xerographic system
26. transfer station
27. photoconductor belt
28. cleaning station In developer station 21 and in cleaning station 28 where excess toner occurs, waste housing 30 accumulates waste toner and other debris and transports it via collection tubes 31 to the waste collector 32 of this invention. While FIG. 1 only shows one waste housing 30 and collection tubes 31, multiple xerographic developer stations of a color system will have multiple waste housings 30 and multiple collection tubes 31 (as shown in FIG. 4 herein). Multiple xerographic units and a typical color system is illustrated in U.S. application Ser. No. 12/189,379 which is incorporated by reference into the present disclosure. For clarity, the specifics of waste collector 32 of this invention are not shown in FIG. 1, but are shown in detail in FIGS. 3, 4, and 5.

Figure 2:
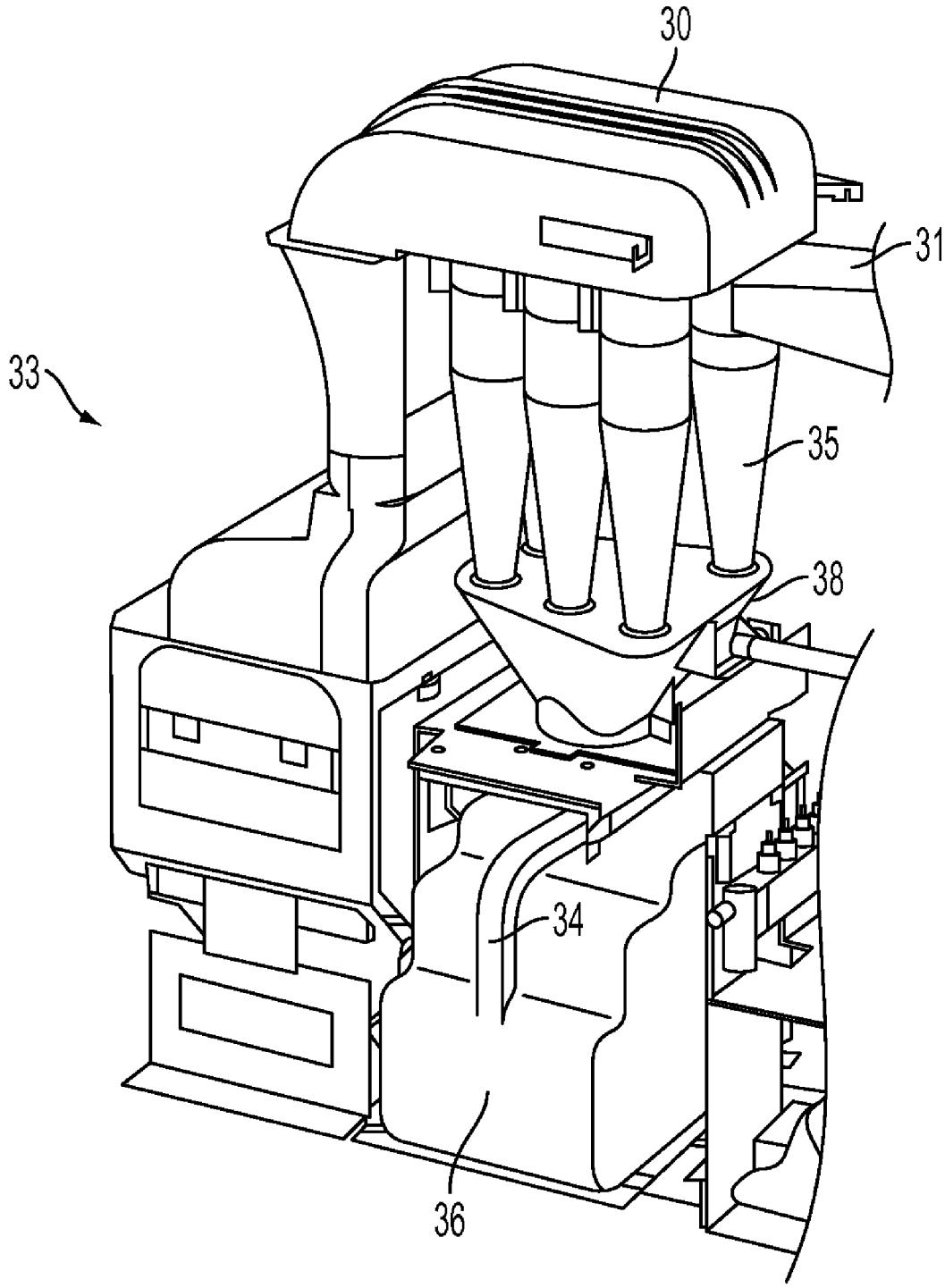
FIG. 2 PRIOR ART
FIG. 2 is a front view of a prior art waste toner collection apparatus using a hard thick plastic collection container.

In FIG. 2 a collection unit 33 of the prior art is shown where a prior art waste dry ink or toner container 36 is used with a removal handle 34. Here the cyclone separators 35 apply a vacuum pressure on the rigid waste container 36. A typical prior art marking system exhausts waste dry ink (toner) at a rate of approximately 320 grams per hour. At this rate, the current prior art waste dry ink container 36 has to be replaced approximately every 25 hours. This prior art waste container 36 has stringent strength requirements such as sustain 6 inches wg vacuum pressure and hold 20 lb. waste; because of these requirements, a very expensive plastic container 36 is currently being used. The high replacement rate of these prior art containers 36 leads to about 35 tons of plastic waste per year for one family of machines. Providing a simpler waste dispense assembly 32 of this invention would make these machines greener by substantially reducing plastic waste in the landfill. It would also reduce the part price cost of a high replaced item, i.e. container 36. Collection tubes 31 lead to cyclone separators 35, the cyclone separator 15 applies a vacuum pressure on the waste container 36. This vacuum pressure exists also in container 36 which accounts for the necessity of rigidity and thickness in container 36. One of the important advantages of the present waste assembly is that there is no need for vacuum pressure in the collection bag 39 since the rotating cylinder gate 37 seals off the pressure in the upper funnel portion 38 from the bag 39. The bag 39 of the present invention together with rotating cylinder gate 37 replaces prior art rigid container 36. The prior art container 36 when filled is pulled out of the prior art assembly 33 and discarded in a landfill, thereby causing some pollution concerns.

Figure 3:
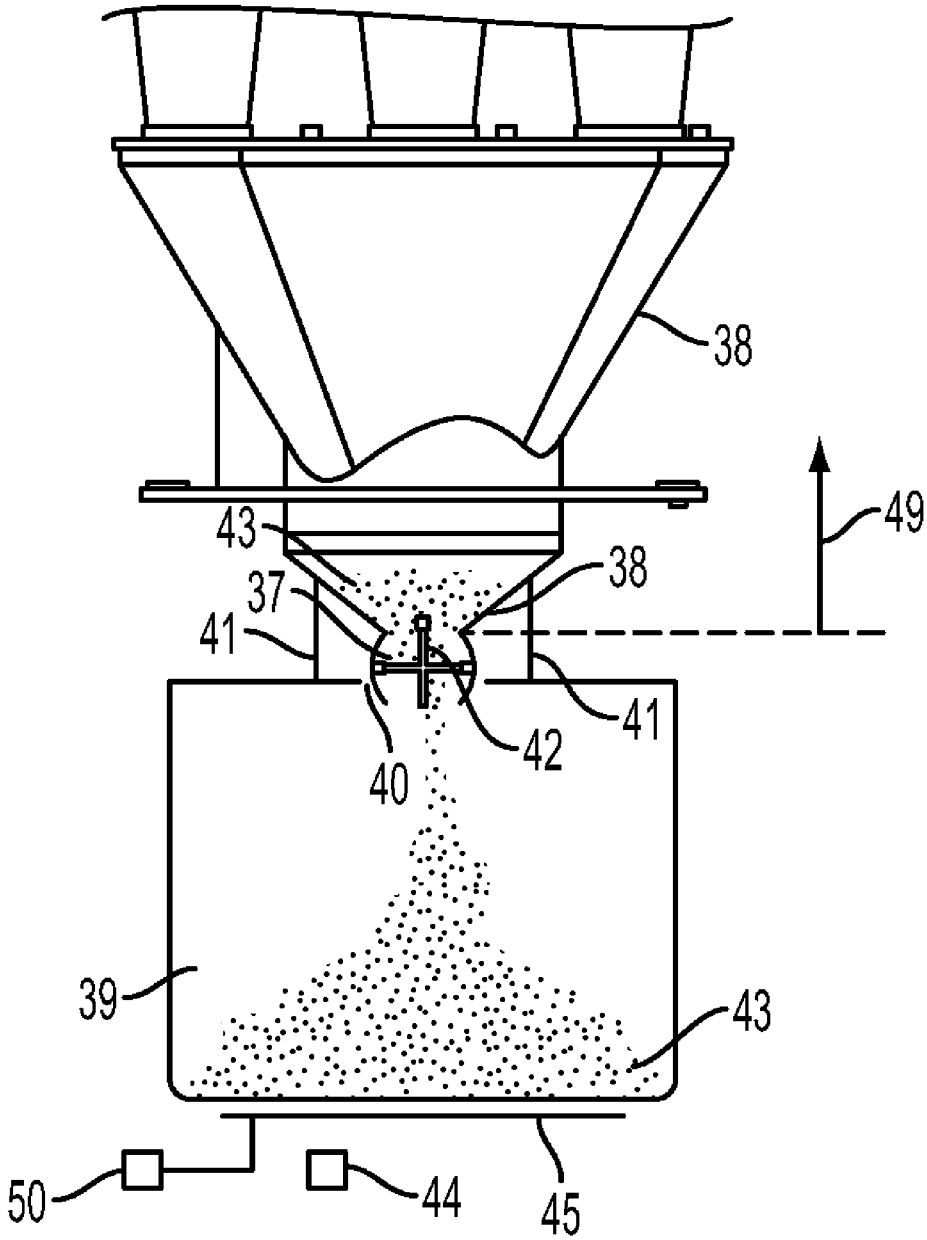
FIG. 3 is a front schematic of the collection assembly of the present invention using a degradable collection bag and a rotating cylinder gate through which waste toner passes into the collection bag.
Figure 4:
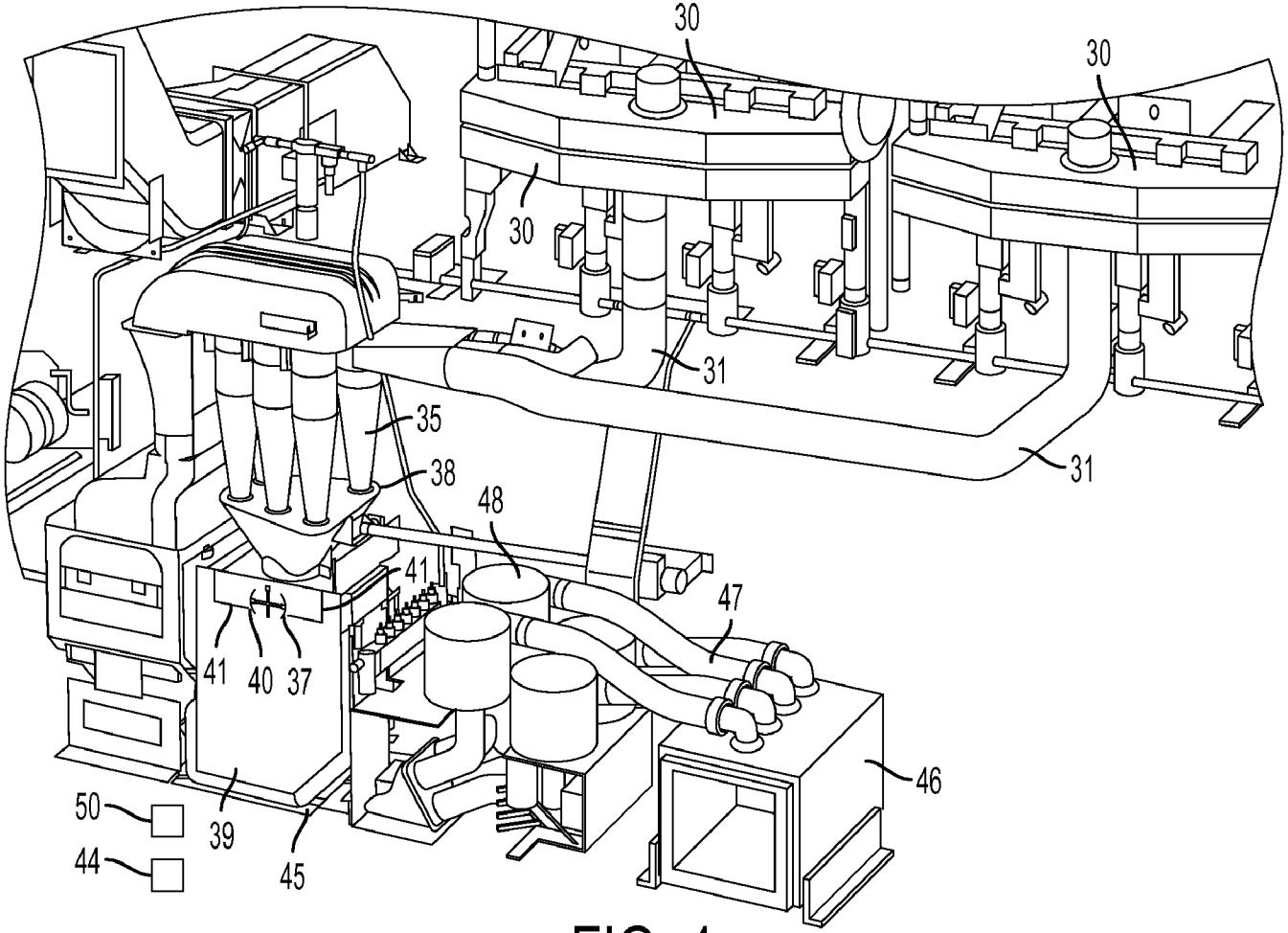
FIG. 4 is a perspective view of the collection assembly of this invention as it is connected to the developer stations of an electrophotographic marking system.

In FIG. 3 a part of the waste collection assembly 32 of this invention is shown where a bag 39 with an opening 40 is used in place of prior art plastic container 36. The cylinder rotating gate 37 seals off the pressure in upper unit funnel portion 38. The cylinder rotating gate 37 of this invention comprises a rubberized seal wall 41 which will seal off any pressure from above because it will fit flush with rotating gate blades 42. As the cylinder rotating gate 37 rotates, it carries with each blade 42 an amount of waste toner 43 for deposition into bag 39. The rubberized seal wall 41 prevents any pressure from entering the bag 39. The gate 37 is connected to a controller 44, the gate 37 is controlled thereby to rotate and let waste toner and debris 43 to dump into the lower non-pressurized bag 39. The pressure remains above the bag 39 but is maintained above as indicated by arrow 49.

In FIG. 4 waste housings 30 from different and multiple developer stations of a color printer are shown as they are connected to waste collection tubes 31. The tubes 31 transport waste toner 43 from the color developer stations to cyclone separators 35 which fields the waste toner 43 into funnel 38 to cylinder rotating gate 37 of this invention. The gate 37 rotates and carries waste toner 43 into degradable bag 39. Below the bag 39 is a weight scale 45 which indicates when the bag 39 is full of waste toner 43 and needs to be removed and replaced with a new bag 39. This FIG. 4 illustrates a portion of a multi-color xerographic unit having at least two separate development stations connected to waste housings 30 and collection tubes 31. The scale 45 when it reaches a certain fixed weight will contact the controller 44 via sensors 50 which will tell the motor to shut down and cause the loading to stop when the bag 39 is filled. Components shown in FIG. 4 that do not constitute part of the collection unit of the present invention but shown for understanding and clarity are air collectors 46 and exhaust tubes 47 and vacuum blowers 48.

Figure 5A:
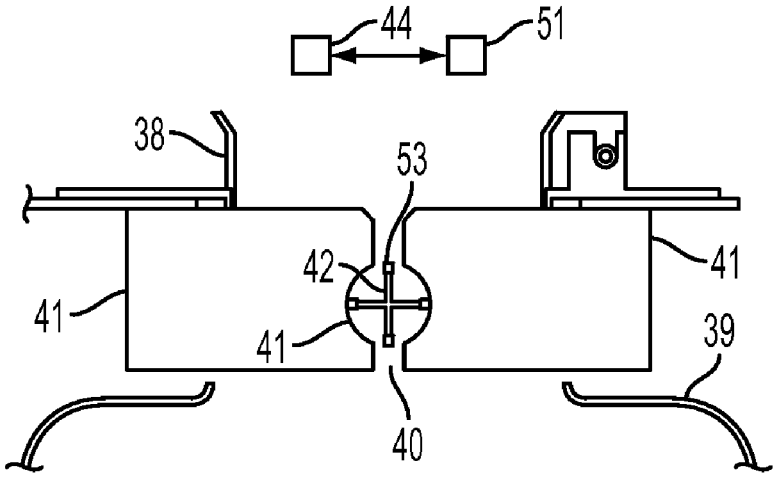
FIG. 5A is an enlarged view of the rotating gate.
Figure 5B:
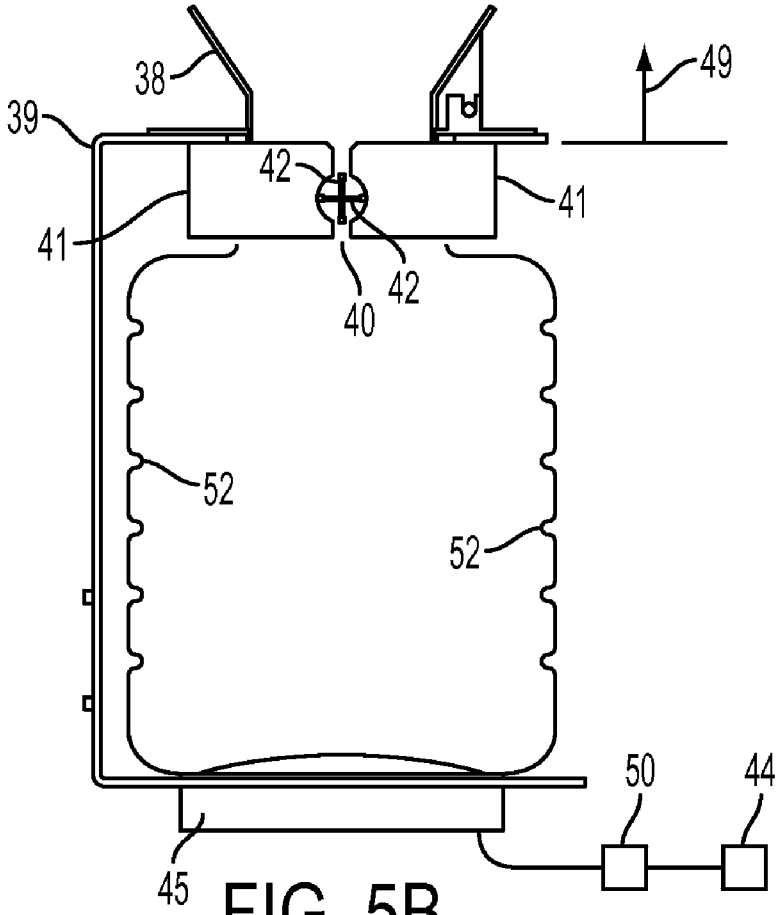
FIG. 5B is an enlarged view of the bag and rotating gate of this invention.

In FIG. 5A an enlarged view of the rotating cylinder gate 37 is shown having rotating blades 42 fit tightly against rubberized side walls 41 to ensure an air tight seal to prevent pressure from reaching bag 39. The blades 42 are connected to a motor and a controller 44 which starts and stops rotation of the blades upon beginning and completion of the bag 39 filling with waste toner and debris. A scale 45 and a sensor 50 indicate when bag 39 is filled and controller 44 turns off the rotation of blades 42 via a stepper motor 51. Sealer walls 41 are constructed of a rubber, latex, plastic, or any other suitable material that will seal off bag 39 pressure and maintain pressure in the system above arrow 49. In FIG. 5B an inner serrated or ribbed embodiment of bag 39 is provided for additional strength supplied by ribs 52; however, any suitable bag 39 with or without ribs 52 can be used. A bag similar to a vacuum bag is one appropriate bag 39 to use. An opening 40 is provided in walls 41 for passage of waste toner into bag 39.

In summary, this invention provides a novel toner waste collection assembly and a novel electrophotographic marking system. The electrophotographic marking system comprises a developer station and the developer station comprises a waste toner dispensing unit. The dispensing unit comprises collection tubes that are configured to convey waste toner to a waste collection assembly. This assembly comprises a funnel portion that is configured to feed waste toner to a rotating gate that is configured to transport the waste toner to a collection bag.

The rotating gate comprises blades that fit tightly in a sealing wall. The marking system comprises a plurality of xerographic structures each having at least one of the collection tubes.

In one embodiment, the system is a color marking system comprising a plurality of color stations; each station comprises at least one collection tube.

In another embodiment, the system is a monochromatic marking system with at least one collection tube. The waste collection assembly is configured to be easily retrofitted into existing electrophotographic marking systems.

The rotating gate is configured to transport waste toner into a collection bag while preventing any pressure existing in an adjacent waste collection assembly from entering the collection bag. The toner waste collection assembly of this invention comprises a controller and collection tubes running from an electrophotographic marking system to a toner collection funnel in the assembly. The toner collecting funnel connects the collection tubes to a rotating gate. This rotating gate is configured to transport waste toner to a replaceable collection bag. The rotating gate is tightly fitted into a sealing wall and this sealing wall is configured to prevent any assembly pressure from entering the bag. The rotating gate has a plurality of blades. The blades are tightly fitted in a sealing manner against the sealing wall. The collection bag is located on and above a weight scale. This scale is configured to indicate when the bag is filled with waste and needs to be replaced. The bag has an opening that is configured to accept waste toner transported by the rotating gate. The blades have rubberized tips to tightly fit against the sealing wall.

The waste collection assembly is configured to transport waste toner into a collection bag while at the same time maintaining only atmospheric pressure in the bag. A weight scale is positioned immediately below the bag and is configured to indicate the weight of the bag and the toner waste in the bag. A motor is connected to the controller. The motor is configured to both energize the rotating gate and shut down the rotating gate.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising:

a cleaning station; and a developer station, said developer station comprising a waste toner dispensing unit, wherein said unit comprises one or more collection tubes configured to convey waste toner from both said developer station and said cleaning station to a waste collection assembly, said assembly comprises a funnel portion configured to feed waste toner to a rotating gate that is configured to transport said waste toner to a collection bag, and said rotating gate comprises blades that fit tightly in and against a sealing wall.

2. The marking system of claim 1 wherein said system comprises a plurality of xerographic structures each having at least one said collection tube.

3. The marking system of claim 1 wherein said system is a color marking system comprising a plurality of color stations, and each said station comprises at least one said collection tube.

4. The marking system of claim 1 wherein said system is a monochromatic marking system.

5. The marking system of claim 1 wherein said rotating gate is configured to transport waste toner into a collection bag while preventing any pressure existing in an adjacent waste collection assembly from entering said collection bag.

6. The electrophotographic marking system of claim 1, wherein the collection bag is oriented such that the waste toner is caused to drop vertically into the collection bag.

7. A toner waste collection assembly comprising:

a controller; and one or more collection tubes running from an electrophotographic marking system to a toner collection funnel in said assembly, wherein said toner collecting funnel connects said collection tubes to a rotating gate, said rotating gate is configured to transport waste toner to a replaceable collection bag, said rotating gate is tightly fitted into and against a sealing wall, and said sealing wall is configured to prevent any assembly pressure to enter said bag.

8. The assembly of claim 7 wherein said rotating gate has a plurality of blades, and said blades are tightly fitted in a sealing manner against said sealing wall.

9. The assembly of claim 8 wherein said blades have rubberized tips to tightly fit against said sealing wall.

10. The assembly of claim 7 wherein said collection bag is located above a weight scale, and said scale configured to indicate when said bag is filled with waste and needs to be replaced.

11. The assembly of claim 7 wherein said bag has an opening configured to accept waste toner transported by said rotating gate.

12. The assembly of claim 7 configured to transport waste toner into a the replaceable collection bag while at the same time maintaining only atmospheric pressure in said bag.

13. The assembly of claim 7 wherein a weight scale is positioned below said bag and is configured to indicate the weight of said bag and said toner waste.

14. The assembly of claim 7 wherein a motor is connected to said controller, and said motor configured to both energize said rotating gate and shut down said rotating gate.

* * * * *